United States Patent [19]

Asano et al.

[11] 4,120,270

[45] Oct. 17, 1978

[54] CLOSED-LOOP MIXTURE CONTROL SYSTEM FOR AN INTERNAL COMBUSTION ENGINE WITH FAIL-SAFE CIRCUIT ARRANGEMENT

[75] Inventors: Masaharu Asano, Yokohama; Makoto Anzai, Yokosuka, both of Japan

[73] Assignee: Nissan Motor Company, Limited, Yokohama, Japan

[21] Appl. No.: 692,193

[22] Filed: Jun. 2, 1976

[30] Foreign Application Priority Data

Jun. 3, 1975 [JP] Japan ..... 50-74368[U]

[51] Int. Cl.[2] ..... F02B 3/00

[52] U.S. Cl. ..... 123/32 EE; 123/119 EC

[58] Field of Search ..... 123/32 EA, 32 EE, 119 EC; 60/276, 285; 340/52 R

[56] References Cited

U.S. PATENT DOCUMENTS

| | | | |
|---|---|---|---|
| 3,916,848 | 11/1975 | Schmidt | 123/32 EE |
| 3,938,479 | 2/1976 | Oberstadt | 123/32 EE |
| 3,948,228 | 4/1976 | Luchco | 340/52 R |

*Primary Examiner*—Samuel Feinberg

*Attorney, Agent, or Firm*—Lowe, King, Price & Becker

[57] ABSTRACT

A closed-loop mixture control system for an internal combustion engine includes an exhaust composition detector to provide information on the air-fuel ratio of the mixture to be controlled and a circuit arrangement which clamps the system to a rich mixture ratio when the operating characteristic of the composition detector becomes abnormal due to either an open or short circuit condition.

10 Claims, 6 Drawing Figures

CLOSED-LOOP MIXTURE CONTROL SYSTEM FOR AN INTERNAL COMBUSTION ENGINE WITH FAIL-SAFE CIRCUIT ARRANGEMENT

FIELD OF THE INVENTION

The present invention relates to closed-loop air-fuel mixture control systems for internal combustion engines, and in particular to such a system in which a fail-safe arrangement is provided to ensure against undesirable consequences resulting from a malfunction of an exhaust composition sensor.

A BACKGROUND OF THE INVENTION

The conventional closed-loop mixture control system using an exhaust composition sensor is limited in performance by the accuracy of the signal provided by the composition sensor. If the sensor should fail, it is likely that the output signal of the sensor has a value which clamps the control loop at an air-fuel ratio so that the engine operates too lean under particular conditions, with the consequent loss of engine output power. From the standpoint of vehicle safety, it is desirable for the control loop to be clamped at a rich mixture rather than at a lean mixture in order to avoid the loss of available engine output power during an emergency.

SUMMARY OF THE INVENTION

Therefore, the primary object of the invention is to provide a closed-loop mixture control system for internal combustion engines in which an electrical signal representing the exhaust composition of the engine is automatically clamped to a predetermined voltage level that maintains the air-fuel ratio of the mixture at a value lower than a predetermined value to which the system is controlled.

Another object of the invention is to provide a fail-safe arrangement for a closed-loop mixture control system of an internal combustion engine.

The above and still further objects, features and advantages of the present invention will become apparent upon consideration of the following detailed description of several specific embodiments thereof, especially when taken in conjunction with the accompanying drawing.

BRIEF DESCRIPTION OF THE INVENTION

FIG. 1 is a general circuit diagram of a closed-loop mixture control system embodying the invention; and FIGS. 2 to 6 are detailed circuits of an input circuit used in the circuit of FIG. 1.

DESCRIPTION OF THE PREFERRED EMBODIMENT

Figure 1:
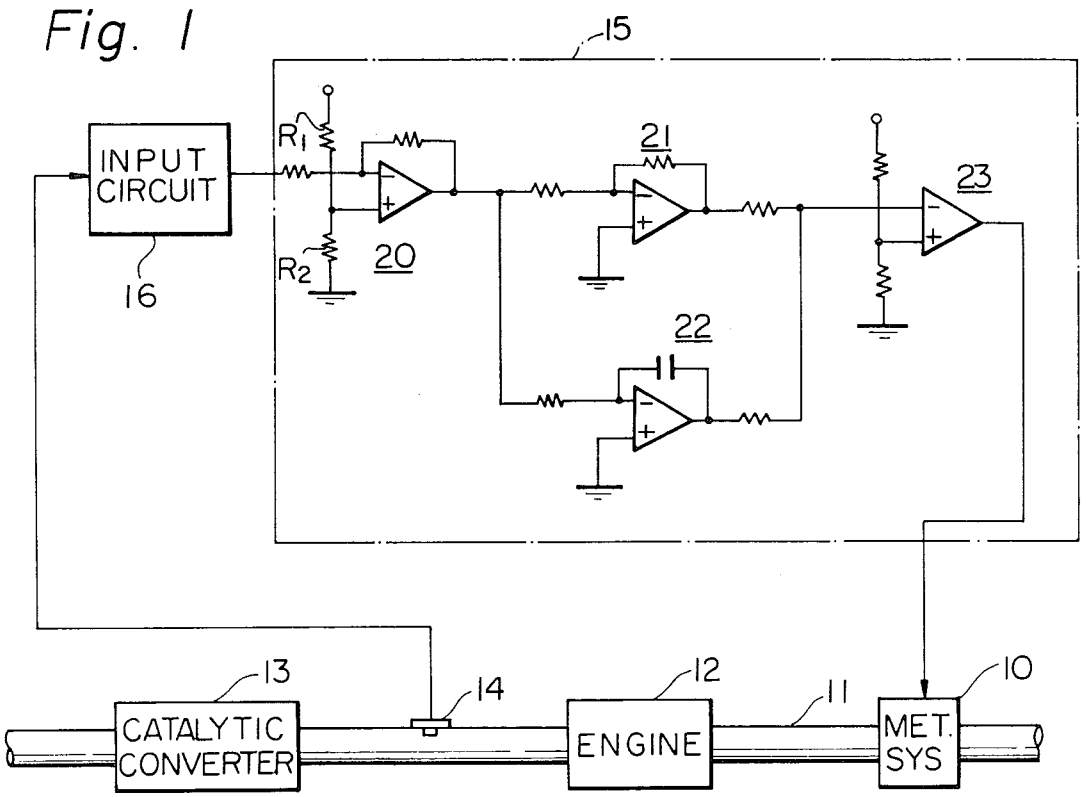

Referring now to FIG. 1, a closed-loop mixture control system embodying the invention is shown schematically. An air-fuel metering system 10 supplies an air-fuel mixtures through induction passage 11 to the cylinders of an internal combustion engine 12. A catalytic converter 13 of a three-way catalyst type, for example, is connected to the exhaust manifold of the engine to convert noxious emissions into harmless water vapor and carbon dioxide at the stoichiometric air-fuel ratio of the mixture. An exhaust composition sensor 14, such as a commercially available zirconium dioxide oxygen sensor, is provided in the exhaust manifold to detect the oxygen concentration of the exhaust gases and provide an output to a control circuit 15 through an input circuit 16. As is well known, sensor 14 generates a first relatively high positive voltage and a second relatively low positive voltage in response to the absence and presence of oxygen, respectively. In addition, sensor 14 has an internal impedance that varies inversely with temperature from a very high impedance at its low nonoperating temperature to a very low impedance at its high operating temperature. The output signal from the control circuit 15 is fed back to the metering system 10 such that the air-fuel ratio is controlled to the stoichiometric value.

The control circuit 15 includes a differential amplifier 20 which provides a differential output representing the difference between the voltage applied to an inverting (−) input of the amplifier and a reference voltage provided at a non-inverting (+) input of the amplifier from a voltage divider $R_1$, $R_2$. A signal of opposite polarity is generated at the output of the amplifier 20 depending upon whether the air-fuel ratio is above or below the stoichiometric value. The output from the differential amplifier 20 is applied to a proportional control amplifier 21 and to an integral control amplifier 22 so that the control system possesses a combined characteristic of proportional and integral control responses. For this reason a summation amplifier 23 is provided to receive the outputs from both control amplifiers 21 and 22 and applies its combined signals to the actuating element of the metering system 10 in a known manner.

Figure 2:
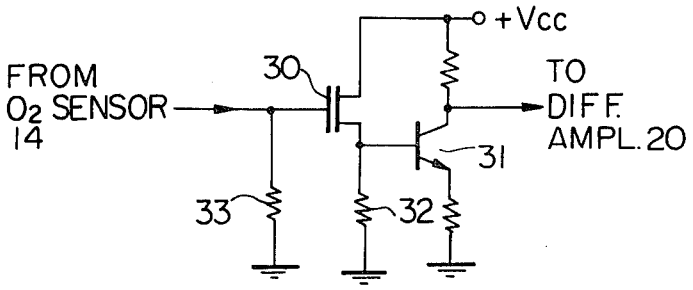

In FIG. 2 one example of the input circuit 16 is illustrated as including a field-effect transistor 30 with a control gate connected to the composition sensor 14 and a source-to-drain path connected between ground and positive voltage supply +Vcc with a resistor 32 being connected between ground and the source electrode. An NPN transistor 31 is provided with its base electrode connected to the source electrode of the FET 30. Should the composition sensor 14 be short-circuited for any reason, both terminals of sensor 4 are at ground potential and the control gate of FET 30 will be clamped to the ground potential with the result that FET 30 is rendered nonconductive. Consequently, the potential developed across the resistor 32 is reduced to the ground potential causing transistor 31 to be turned off, so that the collector of transistor 31 is driven to the high voltage level of +Vcc. This high output corresponds to the maximum voltage which occurs when the air-fuel ratio is leaner than stoichiometric.

Referring again to FIG. 1, if the mixture is leaner than stoichiometric, the input circuit 16 provides a high output voltage to the inverting input of the differential amplifier 20 to exceed the reference voltage and as a result the output from the differential amplifier 20 has a negative polarity. The signal polarity at the output of amplifier 20 is reversed at amplifiers 21 and 22 and further reversed by the summation amplifier 23 so that when the negative polarity output appears at the output of control circuit 15, the metering system 10 is controlled to increase the fuel quantity to shift the air-fuel ratio toward the richer side. Similarly, with the oxygen sensor 14 being short-circuited, a high voltage output is delivered to the differential amplifier 20 from the input circuit 16 so that the control circuit 15 applies a "shift-to-richer-side" signal to the metering system 10.

Conversely, if the composition sensor 14 should fail so it becomes an open circuit or is disconnected from circuit 16, the control gate of FET 30 of the input circuit 16 is held to the ground potential by a resistor 33.

Transistors 30 and 31 are consequently turned off in the same manner as described above and the voltage at the collector of transistor 31 is raised to the maximum voltage.

The oxygen sensor 14 possesses a very high internal resistance of several tens of megohms at low temperatures so an invalid output is derived therefrom until the engine has warmed up sufficiently to raise the temperature of the sensor 14 to the operating range. During the engine start-up period, the control gate of FET 30 is substantially grounded through resistor 33 because of the high internal resistance of the sensor and both transistors 30 and 31 are thus maintained off to provide a high output voltage to increase the fuel quantity. From the foregoing description of the circuit, it is apparent that the impedance of resistor 33 across sensor 14 has an intermediate value between the possible very high (open circuit) and very low (short circuit) internal impedances of the sensor and that when the impedance of the detector is at either of the extreme values, the reference, i.e., ground, potential is coupled to the gate of FET 30.

Figure 3:
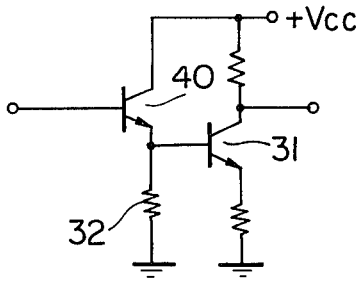

Alternatively, the input circuit 16 is constructed as shown in FIG. 3, which is similar to FIG. 2 with the exception that the FET 30 and resistor 33 are replaced with an NPN transistor 40 having its base connected to the composition sensor 14, its emitter connected to the base of transistor 31 and also to ground through resistor 32 and its collector connected to the voltage source +Vcc. A failure of the composition sensor 14, either a short-circuit or open-circuit, causes both transistors 40 and 31 to go into the blocking state so that the output voltage at the collector of transistor 31 remains high during the time of sensor failures. It is thus apparent that the base emitter impedance of transistor 40, in series with resistor 32, has the same impedance characteristics relative to sensor 14 as resistor 33, of course the emitter base impedance of transistor 40 is far less than the multiple megohm impedance between the control electrode and source of FET 30.

Figure 4:
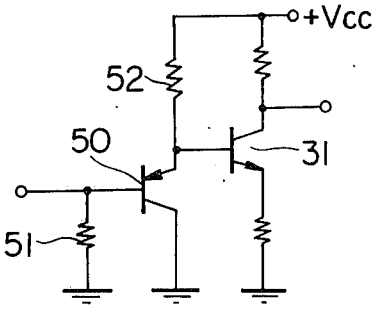

In FIG. 4 is shown a further modification of FIG. 2. The circuit including the FET 30, as well as resistors 32 and 33 in FIG. 2 are replaced with a PNP transistor 50 with a base connected to the composition sensor 14 and to ground through resistor 51, and a collector connected to ground, and an emitter connected to the base of transistor 31 and to the voltage source +Vcc through a resistor 52. A short-circuit failure of the sensor causes transistor 50 to be turned on, to bring the potential at the base of transistor 31 to a level equal to the ground potential, thereby turning of transistor 31. Resistor 51 is selected so that a sufficient base current flow occurs during open-circuit failure of sensor 14 to switch the transistor 50 to the conducting state. The turn-on of transistor 50 in turn brings the potential at the base of transistor 31 to a level equal to the ground potential to thereby turn off transistor 31.

Figure 5:
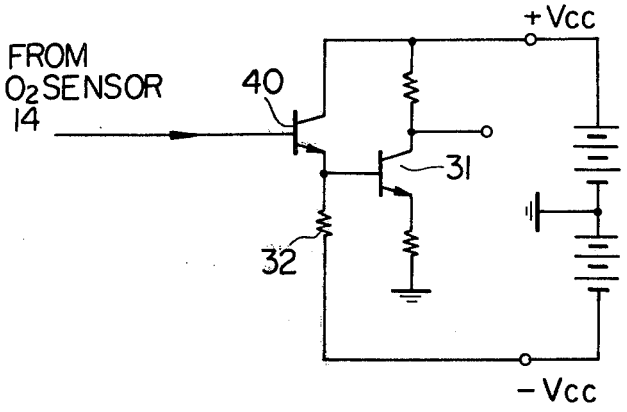

In FIG. 3, when the sensor voltage falls below the voltage across the base and emitter electrodes (0.5 to 0.7 volts) of transistor 40, the collector voltage of transistor 31 does not vary as a function of the input voltage at the base electrode. In order to avoid this undesirable consequence, the circuit of FIG. 3 is modified, as shown in FIG. 5 so the emitter of transistor 40 is connected to a negative voltage source −Vcc through resistor 32, rather than to ground.

Figure 6:
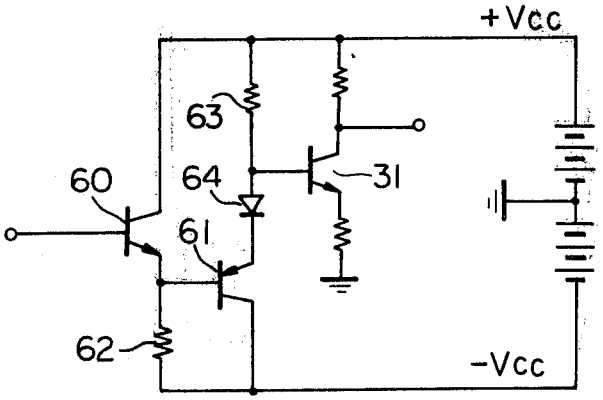

A further modification of the invention is shown in FIG. 6. An NPN transistor 60 is provided with its base connected to the composition sensor 14, the collector being connected to the positive polarity voltage source +Vcc and the emitter being connected to the negative polarity voltage source −Vcc through a resistor 62. A PNP transistor 61 is provided with its base connected to the emitter of transistor 60, the its collector connected to the voltage source −Vcc and the its emitter connected to the positive voltage source +Vcc through a resistor 63 and a diode 64. To the anode terminal of diode 64 is connected the base of transistor 31. A open-circuit failure or sensor 14 turns off transistor 60, which in turn renders transistor 61 conductive. Consequently, transistor 31 is turned off to provide a high voltage output at its collector. The same circuit actions occur when sensor 14 fails to provide a short-circuit or grounded condition to the base of transistor 60, whereby transistor 61 is turned on since its base is negatively biased, thereby resulting in the transistor 31 being switched off to provide a high output voltage at its collector.

What is claimed is:

1. A closed-loop mixture control system for an internal combustion engine including means for supplying air and fuel thereto in variable ratio and means for adjusting said air and fuel supplied to said engine in response to a feedback control signal, comprising:

an exhaust gas sensor operable at a high sensor temperature for generating a first voltage signal in response to the absence of a predetermined constituent gas in the exhaust gas and for generating a second voltage signal in response to the presence of the predetermined constituent gas in the exhaust gas, said sensor having an internal impedance varying inversely with the temperature of said sensor from a very high impedance at its low, nonoperable temperature to a very low impedance at its high operating temperature;

an input impedance circuit means connected to one terminal of said sensor, a second terminal of the sensor being connected to a reference potential, said circuit means connected to said sensor terminals and having an impedance value intermediate said very high and very low internal impedances of said sensor so that when the internal impedance of the said sensor is either at said very high or very low level, said input impedance circuit means develops a potential substantially equal to said reference potential; and an exhaust gas sensor amplifier circuit connected to said input impedance circuit means, the output signal of said amplifier circuit having a first voltage level in response to the internal impedance of said sensor being either very high or very low, said amplifier circuit being adapted to switch between said first voltage level and a second voltage level in response to said first and second voltage signals from said sensor, the output of said amplifier circuit being a feedback control signal which causes said air fuel adjusting means to enrich said supplied air-fuel mixture when the internal impedance of said sensor is very high or very low.

2. A closed-loop mixture control system as claimed in claim 1, wherein said exhaust gas sensor amplifier circuit comprises a field effect transistor having its control gate connected to said detecting means and its drain electrode connected to a first terminal of a voltage source and its source electrode connected to a second terminal of the voltage source through a resistor, and a second transistor having its base connected to the source electrode of the field-effect transistor so as to be responsive to the voltage developed across said resistor and its collector connected to one of the first and second terminals and its emitter connected to the other of said terminals.

3. A closed-loop mixture control system as claimed in claim 2, wherein said second transistor is an NPN transistor having its collector connected to the first terminal of the voltage source and its emitter connected to the second terminal of the voltage source.

4. A closed-loop mixture control system as claimed in claim 1, wherein said amplifier circuit comprises a first NPN transistor having its base connected to the detecting means and its collector connected to a first terminal of a voltage source and its emitter connected to a second terminal of the voltage source through a resistor, and a second transistor having its base connected to the emitter of said first transistor so as to be responsive to the voltage developed across said resistor and its collector connected to one of the first and second terminals of the voltage source and its emitter connected to the other of the first and second terminals.

5. A closed-loop mixture control system as claimed in claim 4, wherein said first and second transistors are of NPN conductivity type, and wherein said second transistor having its collector connected to the first terminal of the voltage source and its emitter connected to the second terminal of the voltage source.

6. The system of claim 4 wherein said second terminal of the voltage source is at the reference potential, and the first transistor is of the NPN type.

7. The system of claim 4 wherein the second terminal of the voltage source is at a negative potential relative to the reference potential, and the first transistor is of the NPN conductivity type.

8. The system of claim 7 wherein the second transistor is of the PNP conductivity type, the emitter, and collector of the second transistor being respectively connected to the first and second terminals of the voltage source, the connection of the emitter of the second transistor to the first terminal being through another resistor and a diode forward biased by the voltage at the first terminal and a third transistor having its control electrode responsive to the voltage at the anode of the diode.

9. A closed-loop mixture control system as claimed in claim 1, wherein said amplififer circuit comprises a first transistor having its base connected to said detecting means and its emitter connected to a first terminal of a voltage source and its collector connected to a second terminal of the voltage source, a second transistor having its base connected to the emitter of said first transistor and its collector connected to one of the first and second terminals of the voltage source and its emitter connected to the other of said first and second terminals, and a resistor connected between the base of the first transistor and the second terminal of the voltage source, the resistance of said resistor being selected such that it allows said first transistor to produce a sufficient base-emitter current flow to turn it on when electrical connection is not substantially present between said detecting means and the base of said first transistor.

10. A closed-loop mixture control system as claimed in claim 9, wherein said first transistor is of PNP conductivity type, and said second transistor is of NPN conductivity type and having its collector and emitter connected to the first and second terminals of the voltage source, respectively.

* * * * *